US007138929B2

(12) United States Patent
Jeffryes et al.

(10) Patent No.: US 7,138,929 B2
(45) **Date of Patent: *Nov. 21, 2006**

(54) METHOD AND APPARATUS FOR ENHANCED ACOUSTIC MUD PULSE TELEMETRY DURING UNDERBALANCED DRILLING

(75) Inventors: Benjamin Peter Jeffryes, Histon (GB); Yan Kuhn De Chizelle, Viroflay (FR)

(73) Assignee: Schlumberger Technology Corporation, Ridgefield, CT (US)

( * ) Notice: Subject to any disclaimer, the term of this patent is extended or adjusted under 35 U.S.C. 154(b) by 487 days.

This patent is subject to a terminal disclaimer.

(21) Appl. No.: 10/203,366

(22) PCT Filed: Mar. 8, 2001

(86) PCT No.: PCT/GB01/01004

§ 371 (c)(1),
(2), (4) Date: Jan. 13, 2003

(87) PCT Pub. No.: WO01/66911

PCT Pub. Date: Sep. 13, 2001

(65) Prior Publication Data

US 2003/0151522 A1 Aug. 14, 2003

(30) Foreign Application Priority Data

Mar. 10, 2000 (GB) ..... 0005746.3
Jun. 9, 2000 (GB) ..... 0014031.9

(51) Int. Cl.
*G01V 1/133* (2006.01)

(52) U.S. Cl. ..... 340/853.1; 367/82; 367/83

(58) Field of Classification Search ..... 340/853.1, 340/853.8, 854.3, 856.3; 367/82, 84; 175/40, 175/48

See application file for complete search history.

(56) References Cited

U.S. PATENT DOCUMENTS 4,590,593 A 5/1986 Rodney
4,733,233 A 3/1988 Grosso et al.
4,878,206 A 10/1989 Grosso et al.
5,146,433 A 9/1992 Kosmala et al.
5,459,697 A 10/1995 Chin et al.
5,535,177 A 7/1996 Chin et al.
5,583,827 A 12/1996 Chin
5,969,638 A 10/1999 Chin (Continued)

FOREIGN PATENT DOCUMENTS

GB 2 147 722 A 5/1985

(Continued)

*Primary Examiner*—Wendy P. Garber
*Assistant Examiner*—Hung Q. Dang
(74) *Attorney, Agent, or Firm*—Steven Gahlings; Jody Lynn DeStefanis; William L. Wang

(57) ABSTRACT

A method and system for telemetry through a compressible drilling fluid during underbalanced drilling is disclosed. A reflector (110) is positioned downstream from the gas inlet (84) and causes reflected pressure waves having the same pressure polarity as incident pressure waves. A pressure sensor (92) is positioned below the reflector to sense pressure in the compressible drilling fluid. The reflector (110) can be a fixed orifice plate or an adjustable aperture. A borehole communication system is also disclosed wherein a pair of pressure sensors are positioned on either side of a flow restriction (118) located in the gas conduit leading to the gas injector. The flow restriction can be a valve used to regulate the flow rate of the gas being supplied into the drilling fluid, or it can be separate venturi or orifice plate.

30 Claims, 5 Drawing Sheets

U.S. PATENT DOCUMENTS 6,097,310 A * 8/2000 Harrell et al. ..... 340/854.3

FOREIGN PATENT DOCUMENTS

GB 2 247 905 A 3/1992
GB 0 617 196 A2 3/1994
GB 2 281 424 A 3/1995
GB 2 290 320 A 12/1995
GB 2 333 787 A 8/1999

* cited by examiner

METHOD AND APPARATUS FOR ENHANCED ACOUSTIC MUD PULSE TELEMETRY DURING UNDERBALANCED DRILLING

FIELD OF THE INVENTION

The present invention relates to the field of telemetry during borehole drilling. In particular, the invention relates to a method and apparatus for signal enhancement for acoustic mud pulse telemetry during underbalanced drilling.

BACKGROUND OF THE INVENTION

It is known that the reception of acoustic telemetry signals travelling through the drilling fluid, often referred to as mud pulse telemetry, is substantially degraded if the drilling fluid inside the drillpipe contains substantial quantities of gas. Gas is often injected into the drilling fluid during underbalanced drilling (or low-head drilling in which the well is not underbalanced, but the bottom hole pressure is reduced by the addition of gas).

Although some of the difficulty in signal reception is an inevitable consequence of the attenuation of the acoustic signal in its passage up the mud column, it is also impeded by the acoustic conditions at the top of the mud column inside the surface system. This is especially true when the gas is injected into the drilling mud in the surface system, where the pressure pulses are to be detected. Because of signal attenuation and impeded acoustic conditions in the surface system, the telemetry signal can often be degraded to a point where conventional mud pulse telemetry is either impossible or impractical.

UK Patent Application GB 2 333 787 A discloses a system for mud pulse telemetry in underbalanced drilling wherein a fluid flow meter is used. The signal from the flow meter is converted into a pressure signal by a differential pressure sensor and is thereafter scaled and recorded as a pressure signal. Thus, instead of measuring the pressure, the system disclosed in GB 2 333 787 A measures the flow rate of the mud. Such systems are prone to degraded signal to noise ratios due to for example noise introduced by the mud pumps and gas introduction system.

SUMMARY OF THE INVENTION

Thus, it is an object of the present invention to provide a system and method for enhanced acoustic mud pulse telemetry during underbalanced drilling wherein the acoustic conditions at the top of the surface system is improved.

According to the invention a borehole communication system for telemetry through a compressible drilling fluid is provided. The system includes a drilling fluid source that supplies drilling fluid under pressure through a conduit towards the drill bit and a gas inlet for supplying gas into the drilling fluid thereby rendering the drilling fluid downstream of the inlet compressible. A pulser in the borehole generates pressure pulses in the compressible drilling fluid corresponding to a predetermined pattern.

A reflector is positioned downstream from the gas inlet and causes in response to incident pressure waves travelling from the pulser towards the surface, reflected pressure waves having the same pressure polarity as the incident pressure waves.

A pressure sensor is positioned below the reflector to sense pressure in the compressible drilling fluid and generate electrical signals corresponding to the sensed pressure.

According to a preferred embodiment the pressure sensor is positioned at least 12 pipe diameters downstream of the reflector. According to a more preferred embodiment the sensor is positioned at least 60 pipe diameters downstream of the reflector. According to a preferred embodiment a processor is provided in electrical communication with the pressure sensor to demodulate the electrical signals generated by the pressure sensor.

According to a preferred embodiment, the energy of an incident pressure wave absorbed by the reflector is greater than 20%. According to a more preferred embodiment the energy absorbed is greater than 30%. According to an even more preferred embodiment the energy absorbed is greater than 40%.

According to a preferred embodiment the reflector has a value of $\lambda_l$ (as defined herein) of greater than about 0.25. More preferably $\lambda_l$ is greater than 0.5, and even more preferably greater than one.

The reflector can be a fixed orifice plate, although according to a preferred embodiment an adjustable aperture is used.

According to an alternative embodiment of the invention, a borehole communication system for telemetry through a compressible drilling fluid is provided that includes a pair of pressure sensors positioned on either side of a flow restriction located in the gas conduit leading to the gas injector. The flow restriction can be the valve used to regulate the flow rate of the gas being supplied into the drilling fluid, or it can be separate venturi or orifice plate.

According to another embodiment of the invention, a combination of the reflector and the pair of pressure sensors in the gas supply line is provided.

The invention is also embodied in a method for detecting telemetry signals travelling from a downhole source towards the surface through a compressible drilling fluid.

DETAILED DESCRIPTION OF THE INVENTION

Figure 1:
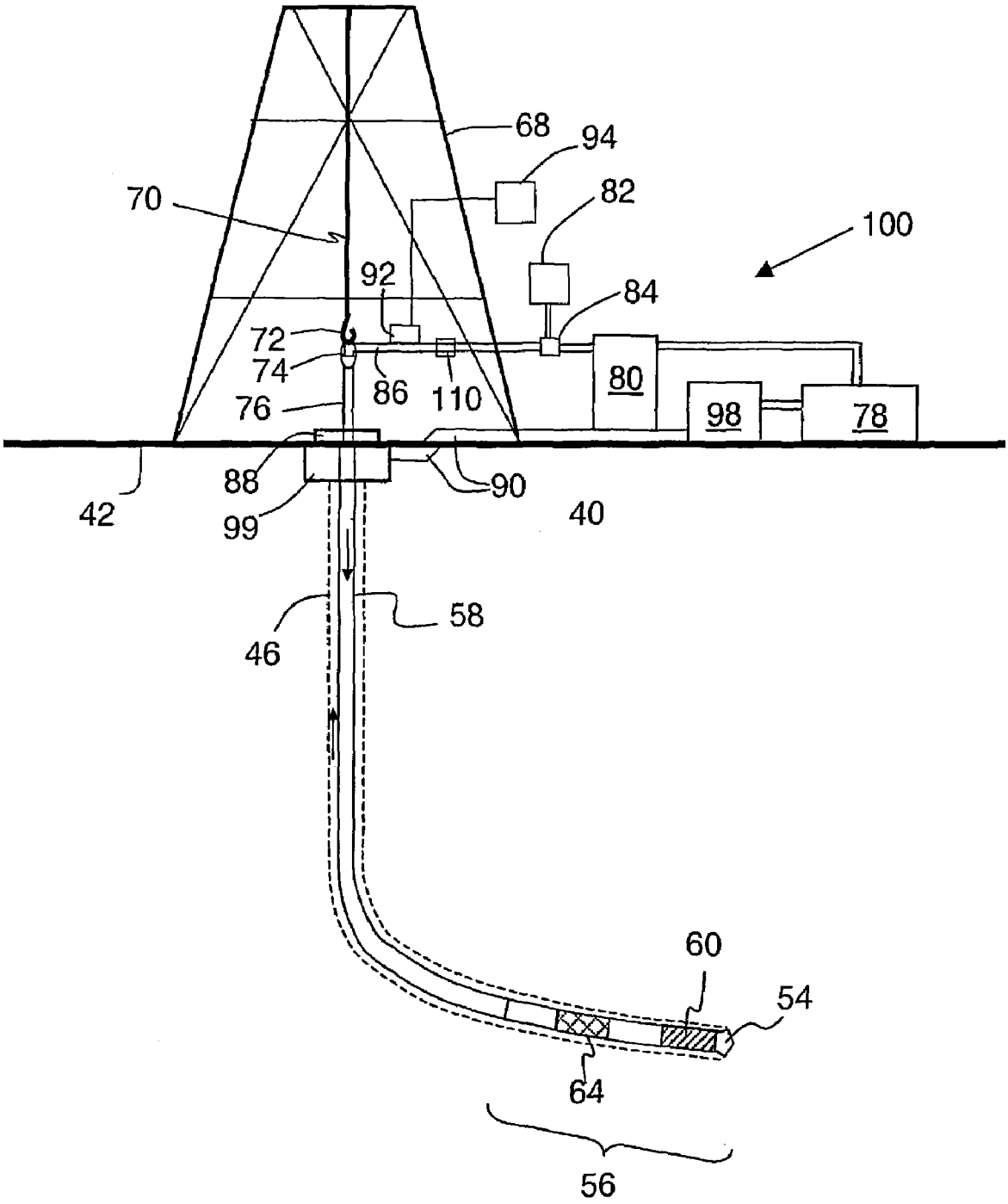
FIG. 1 shows a system for enhanced acoustic mud pulse telemetry during underbalanced drilling, according to a preferred embodiment of the invention.

The following embodiments of the present invention will be described in the context of certain drilling arrangements, although those skilled in the art will recognize that the disclosed methods and structures are readily adaptable for broader application. Where the same reference numeral is repeated with respect to different figures, it refers to the corresponding structure in each such figure.

FIG. 1 shows a system for enhanced acoustic mud pulse telemetry during underbalanced drilling, according to a preferred embodiment of the invention. Drill string 58 is shown within borehole 46. Borehole 46 is located in the earth 40 having a surface 42. Borehole 46 is being cut by the action of drill bit 54. Drill bit 54 is disposed at the far end of the bottom hole assembly 56 that is attached to and forms the lower portion of drill string 46. Bottom hole assembly 56 contains a number of devices including various subassemblies 60. According to the invention measurement-while-drilling (MWD) subassemblies are included in subassemblies 60. Examples of typical MWD measurements include direction, inclination, survey data, downhole pressure (inside and outside drill pipe), resistivity, density, and porosity. The signals from the MWD subassemblies are transmitted to pulser assembly 64. Pulser assembly 64 converts the signals from subassemblies 60 into pressure pulses in the drilling fluid. The pressure pulses are generated in a particular pattern which represents the data from subassemblies 60. The pressure pulses are either positive (increases in pressure) or negative (decreases in pressure) or a combination of positive and negative pressure pulses. The pressure pulses travel upwards though the drilling fluid in the central opening in the drill string and towards the surface system. Subassemblies 60 can also include a turbine or motor for providing power for rotating drill bit 54.

The drilling surface system includes a derrick 68 and hoisting system, a rotating system, and a mud circulation system 100. The hoisting system which suspends the drill string 58, includes draw works 70, hook 72 and swivel 74. The rotating system includes kelly 76, rotary table 88, and engines (not shown). The rotating system imparts a rotational force on the drill string 58 as is well known in the art. Although a system with a Kelly and rotary table is shown in FIG. 1, those of skill in the art will recognize that the present invention is also applicable to top drive drilling arrangements. Although the drilling system is shown in FIG. 1 as being on land, those of skill in the art will recognize that the present invention is equally applicable to marine environments.

The mud circulation system 100 pumps drilling fluid down the central opening in the drill string. The drilling fluid is often called mud, and it is typically a mixture of water or diesel fuel, special clays, and other chemicals. The drilling mud is stored in mud pit 78. The drilling mud is drawn in to mud pumps 80 which pumps the mud though stand pipe 86 and into the kelly 76 through swivel 74 which contains a rotating seal. In order to practice underbalanced drilling, at some point prior to entering the drill string, gas is introduced into drilling mud. In the system shown in FIG. 1, gas, typically nitrogen, supplied by gas source 82 and is injected by gas injector 84.

Upstream from gas injector 84 the drilling mud has a very low compressibility. Gas injector 84 injects gas into the drilling mud such that the fluid downstream of gas injector 84 is a mixture of low-compressibility mud, and gas—typically between a few percent and 30 percent. The gas has a high compressibility, and so the mixture of the two fluids has a reduced density comparable to that of the low-compressibility fluid, but has a much higher compressibility. The effective density of the mixture is approximately equal to the low compressibility mud density times (1−the gas fraction). This results in a much-reduced speed of sound and decreased acoustic impedance over drilling fluid not containing gas.

The mud and gas mixture passes through drill string 58 and through drill bit 54. As the teeth of the drill bit grind and gouges the earth formation into cuttings the mud is ejected out of openings or nozzles in the bit with great speed and pressure. These jets of mud lift the cuttings off the bottom of the hole and away from the bit, and up towards the surface in the annular space between drill string 58 and the wall of borehole 46.

At the surface the mud and cuttings leave the well through a side outlet in blowout preventer 99 and through mud return line 90. Blowout preventer 99 comprises a pressure control device and a rotary seal. Mud return line 90 feeds the mud into separator 98 which separates the mud from the gas, and also preferably removes the cuttings from the mud. From separator 98 the mud is returned to mud pit 78 for storage and re-use.

According to the invention, a reflector 110 is provided in standpipe 86 downstream of the gas injector 84. As will be described in greater detail below, reflector 110 acts to reflect pressure pulses traveling up through the drilling mud generated by pulser assembly 64. The mud pulses are detected by pressure sensor 92, located downstream of the reflector 110 in stand pipe 86. Pressure sensor 92 comprises a transducer that converts the mud pressure into electronic signals. The pressure sensor 92 is connected to processor 94 that converts the signal from the pressure signal into digital form, stores and demodulates the digital signal into useable MWD data. Although reflector 110 and pressure sensor 92 are shown located on the standpipe 86 in FIG. 1, they may also be provided in other locations downstream from the gas injector 84.

Figure 2:
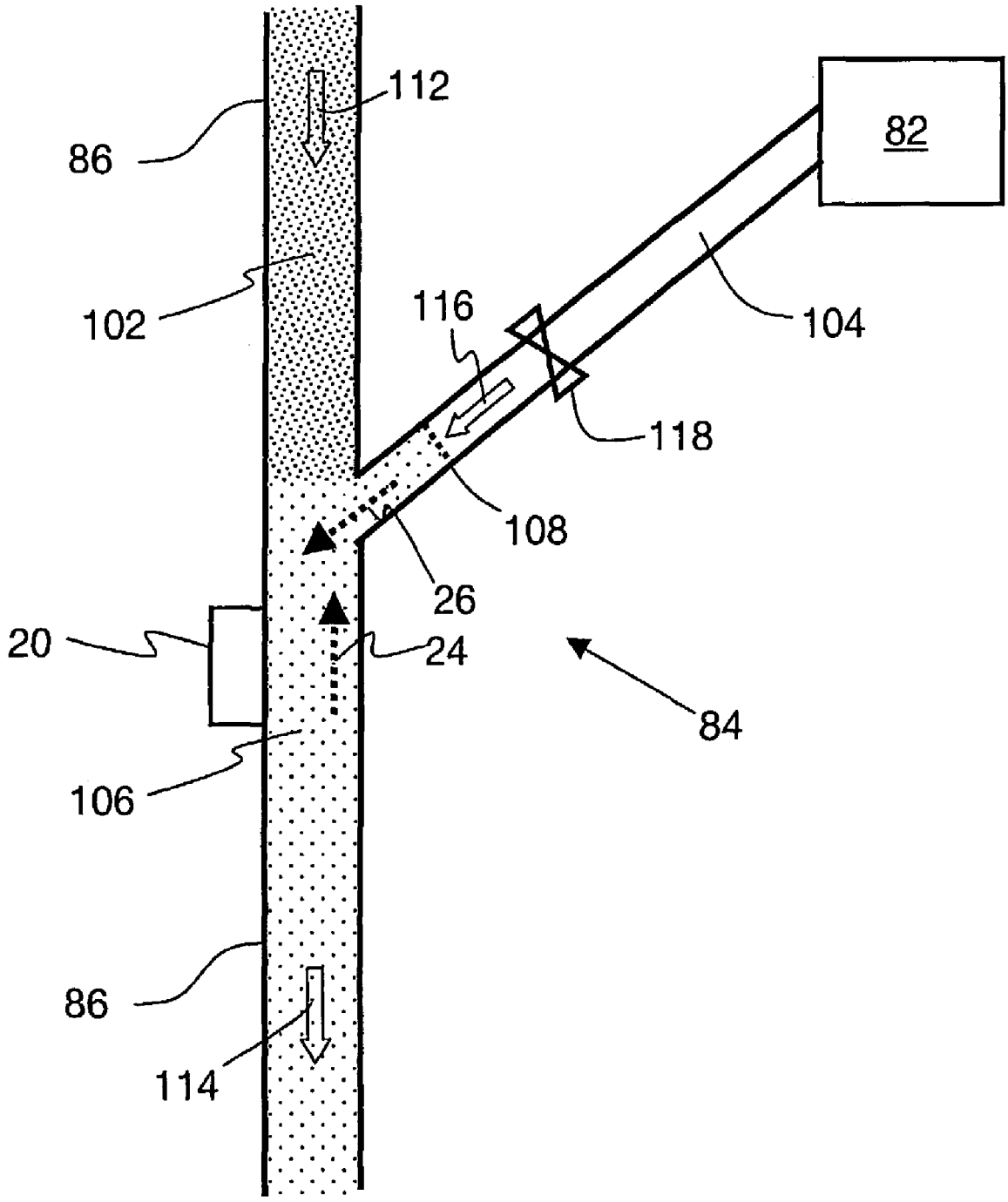
Figure 2 (prior art)
FIG. 2 shows gas injection and conventional pressure measurement arrangement according to the prior art.

FIG. 2 shows gas injection and conventional pressure measurement arrangement according to the prior art. Shown in FIG. 2 is a section of stand pipe 86 in the vicinity of the gas injector 84. Low compressibility mud 102 is shown upstream of gas injector 84 and is flowing in a downward direction as depicted by flow direction arrow 112. Gas supply system 82 supplies gas, typically nitrogen, through conduit 104 as shown by flow direction arrow 116. The flow of gas is controlled primarily by a valve 118, shown schematically. Mud-gas interface 108 is shown in a dashed line. Note that in practice the interface between the gas and mud will not be an abrupt surface, but rather tend to be a mixing zone. Downstream of the interface 108, the mud 106 is a mixture of low-compressibility mud, and gas, typically between a few percent and 30 percent. As mentioned, the mixture of the two fluids has a density comparable to that of the low-compressibility fluid, except having a much higher compressibility. The direction of flow of the high compressibility mud 106 is shown by direction arrow 114.

The low compressibility mud 102 has a much higher acoustic impedance than the mixed-fluid mud 106 which has a much lower acoustic impedance. In this sense the mud 102 can be thought of as a stiff system, and mud 106 as nearly a free-system.

It is believed that an acoustic wave 24 travelling up the mud column is reflected at the gas injector 84. Or more precisely, the reflection occurs at the mud-gas interface 108. This is believed to the case because the mud-gas interface 108 acts nearly as a free-surface. The reflected wave 26 is shown travelling back from the interface. Importantly, the reflection coefficient of such reflections is negative and can be close to minus one. Thus, polarity of the reflected wave 26 is opposite to incident wave 24 and nearly of equal magnitude. As a result of the reflection coefficient being close to minus one at the mud-gas interface 108, a pressure sensor 20 in the vicinity of interface 108 will in this conventional arrangement measure a much-reduced signal, as the reflected wave 26 nearly cancels out the incident wave 24.

Figure 3:
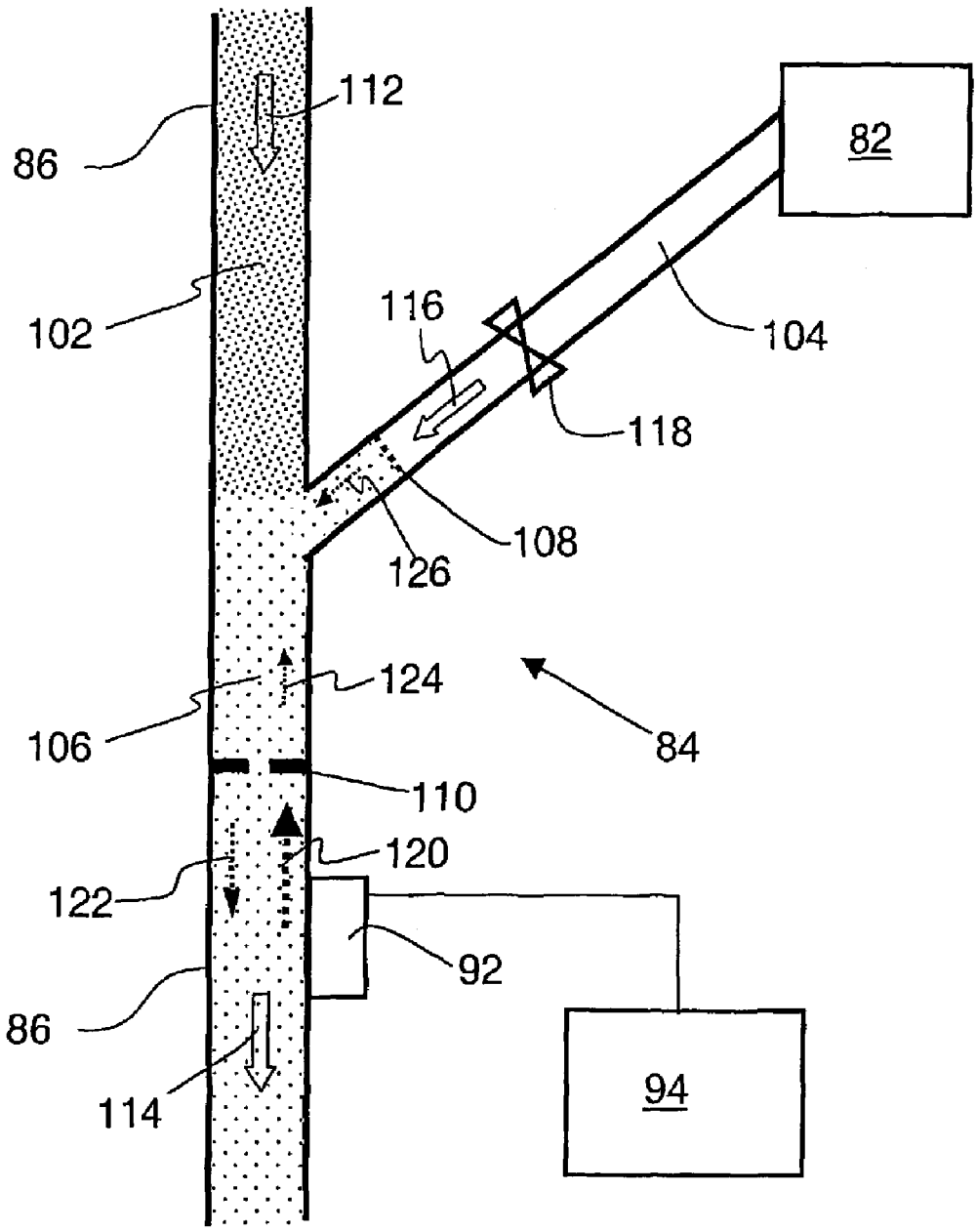
FIG. 3 shows a system for receiving mud pulse signals according to a preferred embodiment of the invention.

FIG. 3 shows a system for receiving mud pulse signals according to a preferred embodiment of the invention. The structure of standpipe 86, gas injector 84 and gas supply 82 are as previously described with respect to FIG. 2 and will therefore not be repeated here. A reflector 110 is positioned within standpipe 86 at a location downstream from the mud-gas interface 108. The reflector 110 effectively reflects a portion of an incident pressure wave 120, shown as reflected wave 122, while allowing a portion of the pressure wave through, shown as pressure wave 124. The transmitted pressure wave 124 will then propagate towards the gas injector 84 and be reflected from mud-gas interface 108. Reflected wave 126 is shown as the reflection of wave 124 from mud-gas interface 108. A portion of reflected wave 126 is then transmitted through the reflector 110.

Importantly, the polarity of the reflected wave 122 is the same as the incident wave 120. Additionally, the amount of energy passing back through the reflector (e.g. from wave 126) and having a polarity opposite to the incident wave 120 is much smaller than if reflector 110 were not present.

Advantageously, a pressure wave incident such as wave 120 is much more easily detectable on the downstream side of reflector 110. Pressure sensor 92 is shown in FIG. 3 located on the downstream side of reflector 110. Sensor 92 detects the mud pressure pulses and comprises a transducer that converts the mud pressure into electronic signals. The pressure sensor 92 is connected to processor 94 that converts the signal from the pressure signal into digital form, stores and demodulates the digital signal into useable MWD data.

Since the wavelength of the mud pressure pulses ordinarily used for borehole telemetry is relatively long. The pressure sensor 92 need not be located immediately downstream of reflector 110, but could be placed further downstream if such placement were more practical. Additionally, as discussed in further detail below, it is preferred that pressure sensor 92 be placed more than about 12 pipe diameters downstream of reflector 110. In the case of FIG. 1, the pipe diameter would be the diameter of standpipe 86. Even more preferably, pressure sensor 92 should be placed more than about 60 pipe diameters downstream from reflector 110.

According to a preferred embodiment, reflector 110 comprises a fixed orifice plate mounted on standpipe 86. The orifice acts as fixed choke in a hydraulic system, but also acts as a reflector in an acoustic system. The orifice thus provides a positive reflection coefficient to waves travelling both upstream and downstream, and also absorbs a proportion of the acoustic signal travelling through it.

Thus, by mounting a choke between the gas injector 84 and pressure sensor 92 then the signal on that sensor will be enhanced. While there will be still be a negative reflection from the gas/fluid interface, the amplitude of the wave incident on that interface will be reduced, and there will additionally be a positive reflection from the choke.

The pressure waves being reflected from reflector 110 can be mathematically described as follows. Let $$z_l = \frac{A_l}{c_l}$$

where $A_l$ is the cross-sectional area of the pipe below (or downstream of) the reflector and $c_l$ is the speed of sound below the reflector (similarly with subscript u for above (or upstream of) the reflector).

According to the invention a useful characteristic of reflectors, $\lambda_l$, is defined as:

$$\lambda_l = \frac{2\Delta}{\rho_l c_l V_l}$$

where $\rho_l$ is the density of the drilling fluid below the reflector, $\Delta$ is the mean pressure drop across the reflector and $V_l$ is the mean flow velocity below the reflector. Then the reflection coefficient from below of the orifice is given by $$R = \frac{\lambda_l - 1 + \frac{z_l}{z_u}}{\lambda_l + 1 + \frac{z_l}{z_u}}$$

The transmission (in terms of pressure) is given by $$T = \frac{2\frac{z_l}{z_u}}{\lambda_l + 1 + \frac{z_l}{z_u}}$$

Thus, referring to FIG. 3, the pressure amplitude of wave 124 is T times the amplitude of incident wave 120, and the pressure amplitude of reflected wave 122 is R times the amplitude of incident wave 120.

$\lambda_l$ has been found as useful measure of the effectiveness of the reflector 110. In general, greater values of $\lambda_l$ for a reflector will result in better pressure signal detection. In practice the upper limit of $\lambda_l$ will be determined by the maximum available pump pressure, the other pressure drops in the drilling assemblies, and the required pressure in the annulus for a particular application. It is believed that useful pressure wave detection is provided even when $\lambda_l$ is in the range of 0.25. According to a more preferred embodiment, $\lambda_l$ should be greater than 0.5. If $\lambda_l$ is in the range of 0.5 or greater the pressure signal enhancement can be significantly improved in many applications. According to an even more preferred embodiment $\lambda_l$ is greater than 1. It is believed that if $\lambda_l$ is greater than about 1 the reflector 110 also can provide a significant reduction in the noise coming from the gas injection and the pumps.

The proportion of the energy in an incident wave 120 absorbed by the reflector 110 is given by:

$$A = \frac{4\lambda_l}{\left(\lambda_l + 1 + \frac{z_l}{z_u}\right)^2}$$

According to a preferred embodiment at least 20% of the energy of an incident pressure wave should be absorbed by reflector 110. According to an even more preferred embodiment, energy absorption of about 30% will provide a significant improvement in signal detection in many applications. According to an even more preferred embodiment, if the energy absorption by reflector 110 is greater than about 40%, a significant reduction in noise from the gas injector and pumps can also be provided.

According to an alternative preferred embodiment, reflector 110 is an adjustable aperture, such as an adjustable choke, which is commercially available. By using an adjustable aperture, the effective values of $\lambda_l$ and energy absorption can be optimized for the particular conditions. For example, when low drilling fluid flow rates are being used, the size of the aperture can be decreased, thus enhancing signal reception, and when high flow rates are required, the aperture can be increase so as to stay within the maximum pumping capacity.

Although the reflector increases the signal strength, it can itself generate noise. The stream of fluid issuing from the small nozzle into the larger diameter pipe produces local flow and pressure fluctuations. These fluctuations are generally of low amplitude, however when the detectable signal is low they may interfere with signal detection. The pressure fluctuations decline with distance from the orifice as only the cross-sectional average of the local pressure fluctuations is capable of propagation at the frequencies of interest, the characteristic length scale of decline being the pipe diameter. Thus, according to a preferred embodiment of the invention the pressure sensor should be located at least 12 pipe diameters downstream of the reflector. According to a more preferred embodiment, it is located at least 60 pipe diameters downstream. In one arrangement, the pressure sensor located at about 75 diameters downstream of the reflector has yielded good results. In FIG. 3, the pipe diameter downstream of reflector 110 is shown with reference letter d, and the distance between pressure sensor 92 and reflector 110 is shown with reference letter x.

Figure 4:
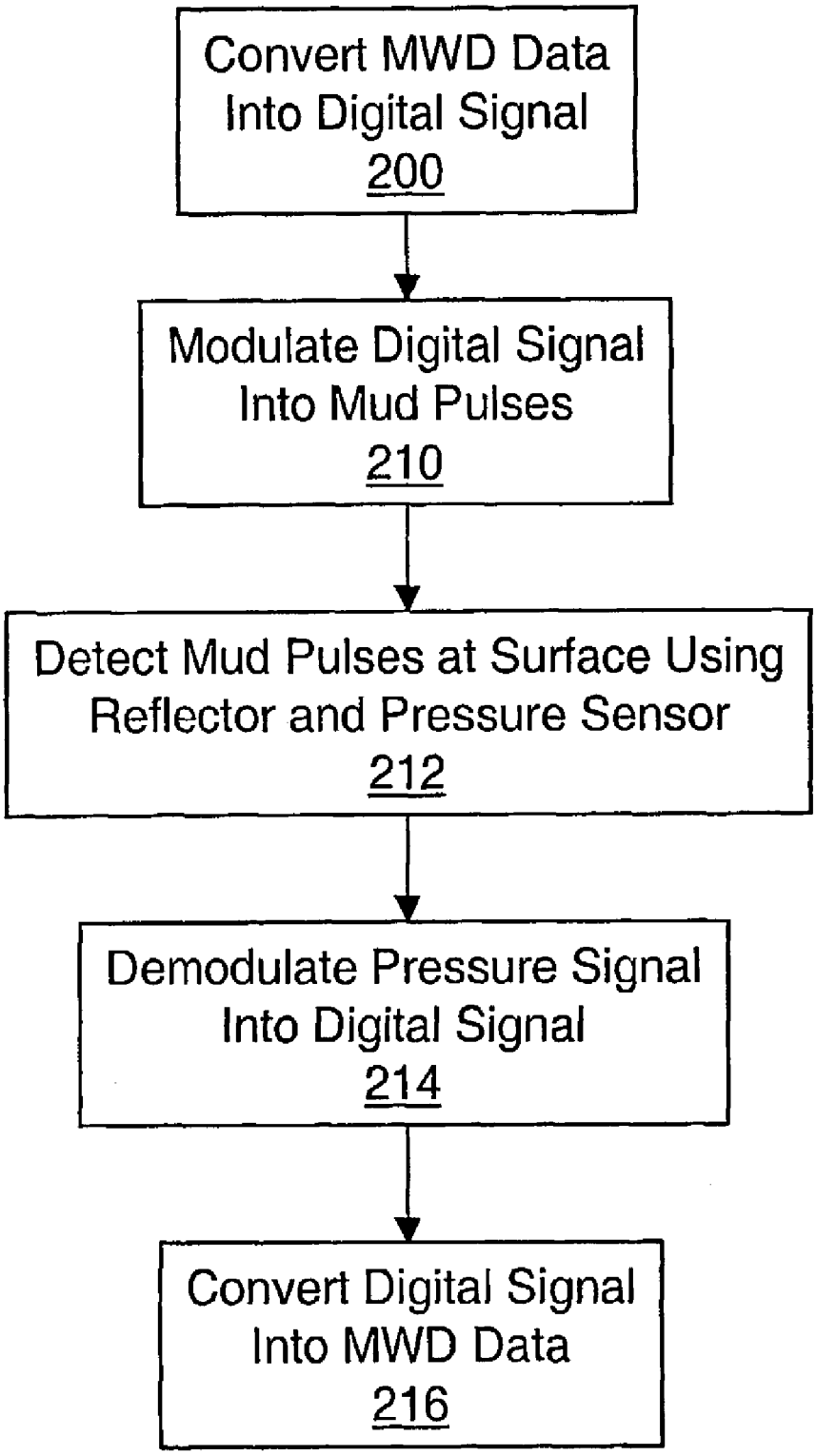
FIG. 4 is a flow chart showing steps in a preferred method of telemetry during underbalanced drilling, according to the invention.

FIG. 4 is a flow chart showing steps in a preferred method of telemetry during underbalanced drilling, according to the invention. In step 200 the MWD data as measured in the bottom hole assembly are converted into digital signals. In step 210 the digital signal is modulated into mud pulses. The mud pulses are generated by a pulser assembly as shown in FIG. 1. The mud pulses travel up the drill pipe towards the surface. At the surface, in step 212 the mud pulses are detected by a pressure sensor located below a suitable reflector as described in FIG. 3. In step 214 the pressure signal from the pressure sensor is demodulated into a digital signal. In step 216 the digital signal is converted back into the MWD data.

Figure 5:
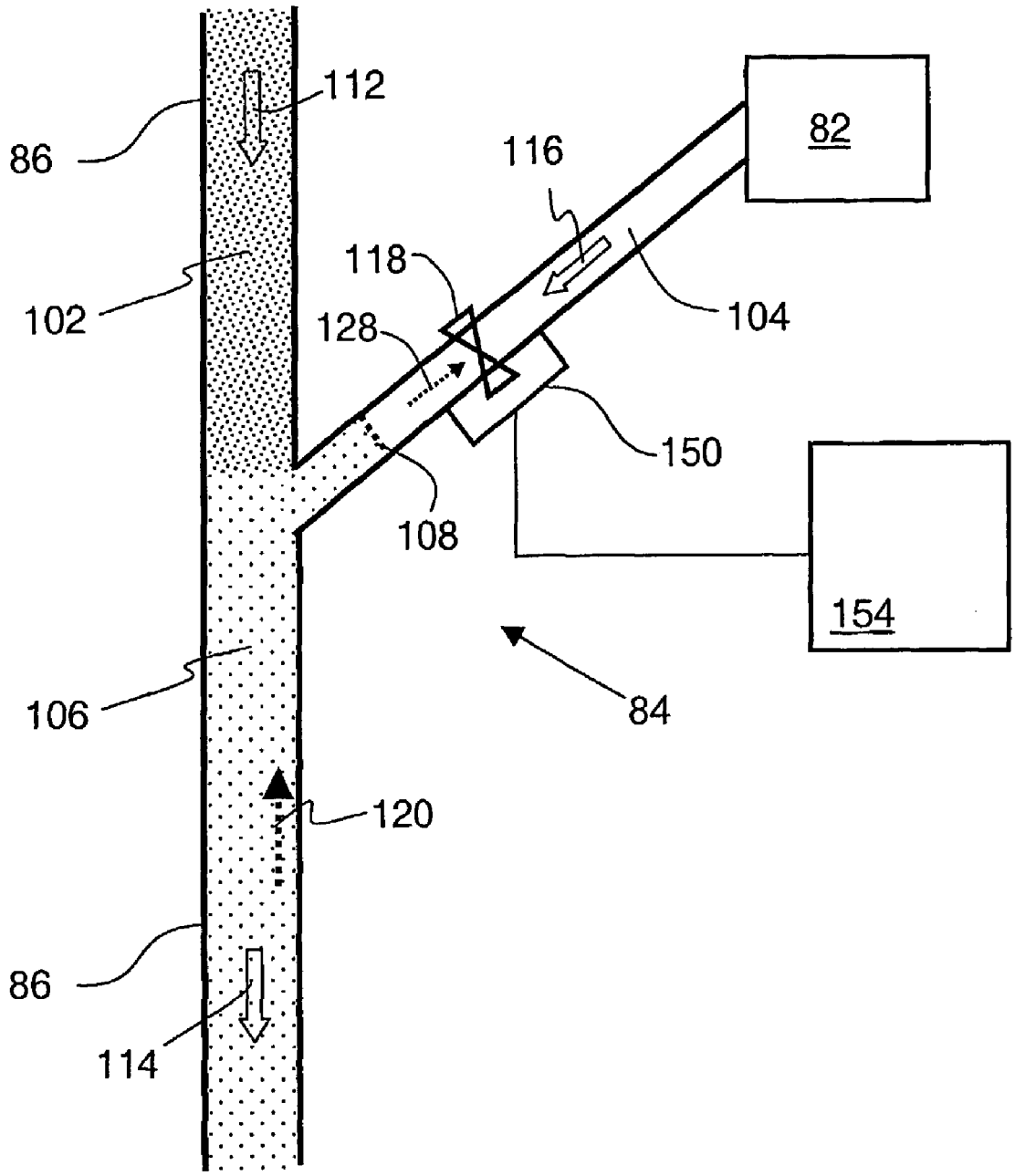
FIG. 5 shows a system for detecting mud pulse signals during underbalanced drilling according to an alternative embodiment of the invention.

FIG. 5 shows a system for detecting mud pulse signals during underbalanced drilling according to an alternative embodiment of the invention. A consequence of the mud-gas interface 108 acting nearly as a free surface is that flow rate variations caused by an incident acoustic wave 120 will be enhanced. The reflected wave, while nearly removing the pressure fluctuations at the interface, nearly doubles the flow rate fluctuations. The flow rate fluctuations will be present both in the mud 106 below the interface 108 and in the gas in conduit 104. A fluid passing through a structure such as an orifice, venturi, or a valve produces a pressure drop across the structure. A varying flow induces a varying pressure drop. The response is non-linear, but small fluctuations produce a nearly linear response, and hence the varying pressure drop may be used as an input for a signal demodulation system.

While the same flow rate fluctuations are present in both the mud system above and below the injector, the steady state rate (and hence the pressure offset) on which these are superimposed will normally be much lower in the injection system. For example, if the gas fraction is 10 percent, then the steady state rate will be one-tenth of the rate below injector 84, hence an instrumented pressure drop above the injector 84 will have a much greater sensitivity than one mounted below the injector.

As shown in FIG. 5 the gas injection system consists of a conduit 104 between the gas supply 82 and the injector 84. The flow rate fluctuations will decline between the injector and the pump system. Thus the pressure drop is preferably measure as close as practical to the gas injection point. Although as shown in FIG. 5 a differential pressure meter 150 is positioned across valve 118, another structure, such as an orifice or venturi, that creates a suitable pressure drop can be used. The differential pressure measurements are transmitted to processor 154 for recording and demodulation. Alternatively, a flow sensor other than differential pressure across a restriction can be uses. For example, Coriolis, ultrasonic, or temperature transfer methods could be used for measuring the flow rate of the gas.

According to another embodiment, a hybrid telemetry system is used wherein the measurement systems of both FIGS. 3 and 5 are used in combination. According to this embodiment a reflector 110 is provided and pressure measurement is performed by pressure sensor 92 as shown and described above with respect to FIG. 3. Additionally, the differential pressure meter 150 can be used on the gas conduit 104, as shown in FIG. 5. Using both methods of detection in combination would advantageously increase signal reception when pump peak pressure limits keep down the reflection coefficient possible at the reflector.

While preferred embodiments of the invention have been described, the descriptions are merely illustrative and are not intended to limit the present invention.

What is claimed is:

1. A borehole communication system for telemetry through a compressible drilling fluid comprising:

a drilling fluid source configured to supply drilling fluid under pressure through a conduit towards a drill bit;

a gas inlet in fluid communication with the conduit configured to supply gas into the drilling fluid thereby rendering the drilling fluid downstream of the inlet compressible;

a pulser in the borehole configured to generate pressure pulses in the compressible drilling fluid corresponding to a predetermined pattern;

a reflector positioned downstream from the gas inlet dimensioned so as to cause in response to an incident pressure wave travelling from the pulser towards the surface, a reflected pressure wave having the same pressure polarity as the incident pressure wave; and a pressure sensor positioned downstream of the reflector adapted to sense pressure in the compressible drilling fluid and generate electrical signals corresponding to the sensed pressure.

2. The system according to claim 1 wherein the conduit includes a drill string and surface conduits and the gas inlet is located on one of the surface conduits.

3. The system according to claim 2 wherein the pulser is located in a bottom hole assembly in the vicinity of the drill bit.

4. The system according to claim 1 further comprising a processor in electrical communication with the pressure sensor adapted to demodulate the electrical signals generated by the pressure sensor.

5. The system according to claim 1 wherein the energy of an incident pressure wave absorbed by the reflector is greater than 20%.

6. The system according to claim 5 wherein the energy of an incident pressure wave absorbed by the reflector is greater than 30%.

7. The system according to claim 6 wherein the energy of an incident pressure wave absorbed by the reflector is greater than 40%.

8. The system according to claim 1 wherein the reflector has a value of $\lambda_1$ of greater than about 0.25.

9. The system according to claim 8 wherein the reflector has a value of $\lambda_1$ of greater than about 0.5.

10. The system according to claim 9 wherein the reflector has a value of $\lambda_1$ of greater than about 1.

11. The system according to claim 1 wherein the reflector is a fixed orifice plate.

12. The system according to claim 1 wherein the reflector comprises an adjustable aperture.

13. The system according to claim 1 wherein the compressible drilling fluid is highly compressible.

14. The system according to claim 1 wherein the pressure sensor is positioned on the conduit downstream of the reflector at a distance of more than about 12 times the diameter of the conduit from the reflector.

15. The system according to claim 14 wherein the pressure sensor is positioned more than about 60 times the diameter of the conduit from the reflector.

16. The system according to claim 1 further comprising:

a gas supply in fluid communication with the gas inlet via a gas conduit; and first and second pressure sensors positioned on either side of a flow restriction located in the gas conduit.

17. A method for detecting telemetry signals travelling from a downhole source towards the surface through a compressible drilling fluid comprising the steps of:

reflecting incident pressure waves in the compressible drilling fluid travelling towards the surface, thereby generating reflected pressure waves having the same pressure polarity as the incident pressure waves; and sensing the pressure of the compressible drilling fluid at a location downstream of where the reflections are generated.

18. The method of claim 17 wherein the pressure is sensed using a pressure sensor, and further comprising the step of demodulating electrical signals generated by the pressure sensor using a processor in electrical communication with the pressure sensor.

19. The method of claim 17 wherein the energy of an incident pressure wave absorbed during reflection is greater than 20%.

20. The method of claim 19 wherein the energy of an incident pressure wave absorbed during reflection is greater than 40%.

21. The method of claim 17 wherein a reflector is used to generate the reflections, the reflector having a value of $\lambda_1$ of greater than about 0.25.

22. The method of claim 21 wherein the reflector has a value of $\mu_1$ of greater than about 1.

23. The method of claim 17 wherein an adjustable aperture is used to generate the reflections.

24. The method of claim 17 wherein a reflector is used to generate the reflections, and the pressure is sensed at a location in a conduit located downstream at a distance of more than about 12 times the diameter of the conduit from the reflector.

25. The method of claim 24 wherein the pressure is sensed at a position more than about 60 times the diameter of the conduit from the reflector.

26. A borehole communication system for telemetry through a compressible drilling fluid comprising:

a drilling fluid source configured to supply drilling fluid under pressure through a conduit towards a drill bit;

a gas inlet in fluid communication with the conduit configured to supply gas into the drilling fluid thereby rendering the drilling fluid downstream of the inlet compressible;

a gas supply m fluidly connected to the gas inlet with k a gas conduit;

a pulser in the borehole configured to generate pressure pulses in the compressible drilling fluid corresponding to a predetermined pattern; and a flow sensor positioned in the gas conduit adapted to measure the flow rate of the gas. wherein the flow sensor comprises a first and a second pressure sensor positioned on either side of a flow restriction located in the gas conduit.

27. The system of claim 26 wherein the flow restriction is a valve used to regulate the flow rate of the gas being supplied into the drilling fluid.

28. The system of claim 26 wherein the flow restriction is a venturi.

29. The system of claim 26 wherein the flow restriction is an orifice plate.

30. The system of claim 26 further comprising:

a reflector positioned downstream from the gas inlet dimensioned so as to cause in response to an incident pressure wave travelling from the pulser towards the surface, a reflected pressure wave having the same pressure polarity as an incident pressure wave; and a pressure sensor positioned below the reflector adapted to sense pressure in the compressible drilling fluid and generate electrical signals corresponding to the sensed pressure.

* * * * *